United States Patent [19]

Teich et al.

[11] Patent Number: 4,742,334

[45] Date of Patent: May 3, 1988

[54] SINGLE-WIRE LOOP ALARM SYSTEM

[75] Inventors: Rudor M. Teich, South Orange; Keith Guillaume, Edison; Ram Shalvi, Teaneck, all of N.J.

[73] Assignee: Tracer Electronics Inc., South Orange, N.J.

[21] Appl. No.: 898,099

[22] Filed: Aug. 20, 1986

[51] Int. Cl.[4] ..... G08B 26/00

[52] U.S. Cl. ..... 340/505; 340/508; 340/510; 340/511; 340/514; 340/825.07; 340/825.08

[58] Field of Search ..... 340/505, 506, 508, 509, 340/510, 511, 512, 514, 825.06–825.13, 825.54, 518

[56] References Cited

U.S. PATENT DOCUMENTS 4,394,655 7/1983 Wynne et al. ..... 340/505
4,423,410 12/1983 Galvin et al. ..... 340/505
4,555,695 11/1985 Machida et al. ..... 340/518
4,613,848 9/1986 Watkins ..... 340/524

*Primary Examiner*—Donnie L. Crosland
*Attorney, Agent, or Firm*—Gottlieb, Rackman & Reisman

[57] ABSTRACT

A single-wire loop alarm system in which the status of each alarm switch can be determined and which is relatively immune to the effects of noise. False alarms are avoided by incorporating an integrator in the loop potential test circuit; during polling, however, the integrator is switched out. Low-frequency noise is discriminated against by verifying the existence of an alarm condition; the loop current is doubled and, if the alarm condition is being caused by an impedance-introducing open alarm switch, the loop voltage change should double. Polling is made more reliable by relying on a "window" test, rather than a simple threshold test.

24 Claims, 3 Drawing Sheets

INSTALLED PANEL
ARMED
+6
EOL
SW1
SW2
SW3
SWN
IDM1
IDM2
IDMN
SWITCHER
+35
DS4
DS3
K1
100
10
12
14
16
18
20
22
24
26
28
30
32
34
36
38
40
42
50
52
54
56
58
ADC 0852
DI
DO
CHO
CHI
CLK
CS
μP 8749
D7
P27
D6
T1
GND
P23
P24
R
P10-P17
P20-P21
P22
D0
T0
D2
D1
XTAL1
XTAL2
POWER SUPPLY
+35
+5
TIMERS
TRACER PANEL
STATUS LOCATION
ALARM
ARMED
BYPASS
HISTORY
DS1-DELAY
DS2-POL
TEST POINT

IDM I
SW I
SWITCHER
26
37
+35
52
50
21
36
38
34
23
25
27
29
33
31
54
CH0
CH1
CS
DI
DO
CLK
30
P25
D7
P27
P22
D5
D4
D0
T0
D2
D1
μP
8749

SINGLE-WIRE LOOP ALARM SYSTEM

This invention relates to alarm systems, and more particularly to such systems which are highly immune to noise.

In application Ser. No. 838,595, filed on Mar. 11, 1986 and entitled "Single-Wire Loop Alarm System," which application is hereby incorporated by reference, there is disclosed an alarm system for use with a conventional-type single-wire loop. By placing a unique identification module across each switch in the loop, it is possible to determine during a polling sequence which switches are open. In order to retrofit an existing system, all that is required, in addition to placing an identification module across any switch which must be identified when open, is to place a central control in the existing system between the installed alarm panel and the two ends of the single-wire loop. The identification modules are not self-powered. As long as an alarm switch is closed, no current flows through the associated identification module since it is shorted by the normally-closed switch. However, when the switch opens current is no longer by-passed and it flows through the module; the loop current now powers the module.

When an alarm switch opens and the associated identification module is powered, a voltage drop, 5 volts in one example, appears across the input of the module. It is the powering of the identification module which is reflected as a changed loop characteristic—in this case, an increased impedance. The central control causes a constant current to flow through the loop, derived from a 35-volt supply. Because there is now a drop of 5 volts across the open switch, there is an increased potential drop across the two ends of the loop at the control panel. It is this changed potential which informs the central control that a switch is open. Because a 35-volt supply is used, and there is a 5-volt drop across each switch when it is open, the system is capable of identifying the number of open switches, up to 6.

The central control, which includes what is called a tracer panel, initiates a polling cycle by pulsing the loop. The loop current is caused to momentarily cease for 1 millisecond, at 2-millisecond intervals. The total number of current cessations in this manner represents the address of the module being interrogated. Only when the total count in any interrogation cycle equals the address of a module does it take action, provided that its associated switch is open and it is powered in the first place. The module changes the loop characteristic at this time, and causes the voltage drop across the switch to be reduced from 5 volts to 3 volts. The momentary change which is sensed at the tracer panel is an indication that the alarm switch now being addressed is open.

The above-described system, while highly efficacious, may be subject to erroneous operation in the presence of noise. The general object of the present invention is to minimize the effects of noise on the system operation.

One problem is that noise can cause an erroneous indication unless the signal being monitored is integrated so as to smooth out transients. But use of a filter slows down the response time and could severly affect the number of switches which could be included in the system if polling speed is important. The problem is solved in accordance with the principles of the invention by providing two sense channels—one with an integrator and one without. The slow channel is used for measurements of loop voltage and all non-time critical loop monitoring functions. The fast channel is used to poll the modules once it is determined that an alarm condition exists.

Another problem is that filtering (integration) does not guard against slow-varying noise. An alarm condition is supposed to be sensed only when an open switch causes its associated module to introduce an impedance in the loop; the constant current which flows through this impedance causes a voltage drop to appear across the loop. Unfortunately, even slow-varying noise can do the same thing. This problem is solved in accordance with the principles of the invention by verifying the source of the sensed voltage drop. The loop current is doubled in one embodiment of the invention immediately after an alarm condition is sensed. If the voltage drop also doubles, it is an indication that the source of the drop is indeed resistive, an open switch. If the voltage drop does not double, it is an indication that noise could be appearing on the loop. In general, the verification scheme entails changing the loop current and checking whether a linear function characterizes the change in loop voltage.

A third problem arises during polling of the switches. For reasons to be explained, a programmable comparator is used to sense a responding module (which causes its 5-volt drop to momentarily reduce to a 3-volt drop). A threshold level is set in the comparator and a test is performed to see whether the responding module causes a voltage change in the loop which is sufficient to cause the comparator threshold to be crossed. Unfortunately, noise can also cause a "crossing." The solution to this problem is to check that the changed loop voltage is within a "window," not merely that it crosses a threshold at one limit of the window. What makes the scheme practical is the use of a hardware-controlled offset for the comparator; a software approach, used in the other measurements taken by the system, would slow things down so much that use of a window would not be practical. The noise rejection is enhanced by the use of an adaptive reference level and pre-pulsing of the loop to compensate for parasitic capacitances, both to be described.

Further objects, features and advantages of the invention will become apparent upon consideration of the following detailed description in conjunction with the drawing, in which.

Figures 1, 2, 3:
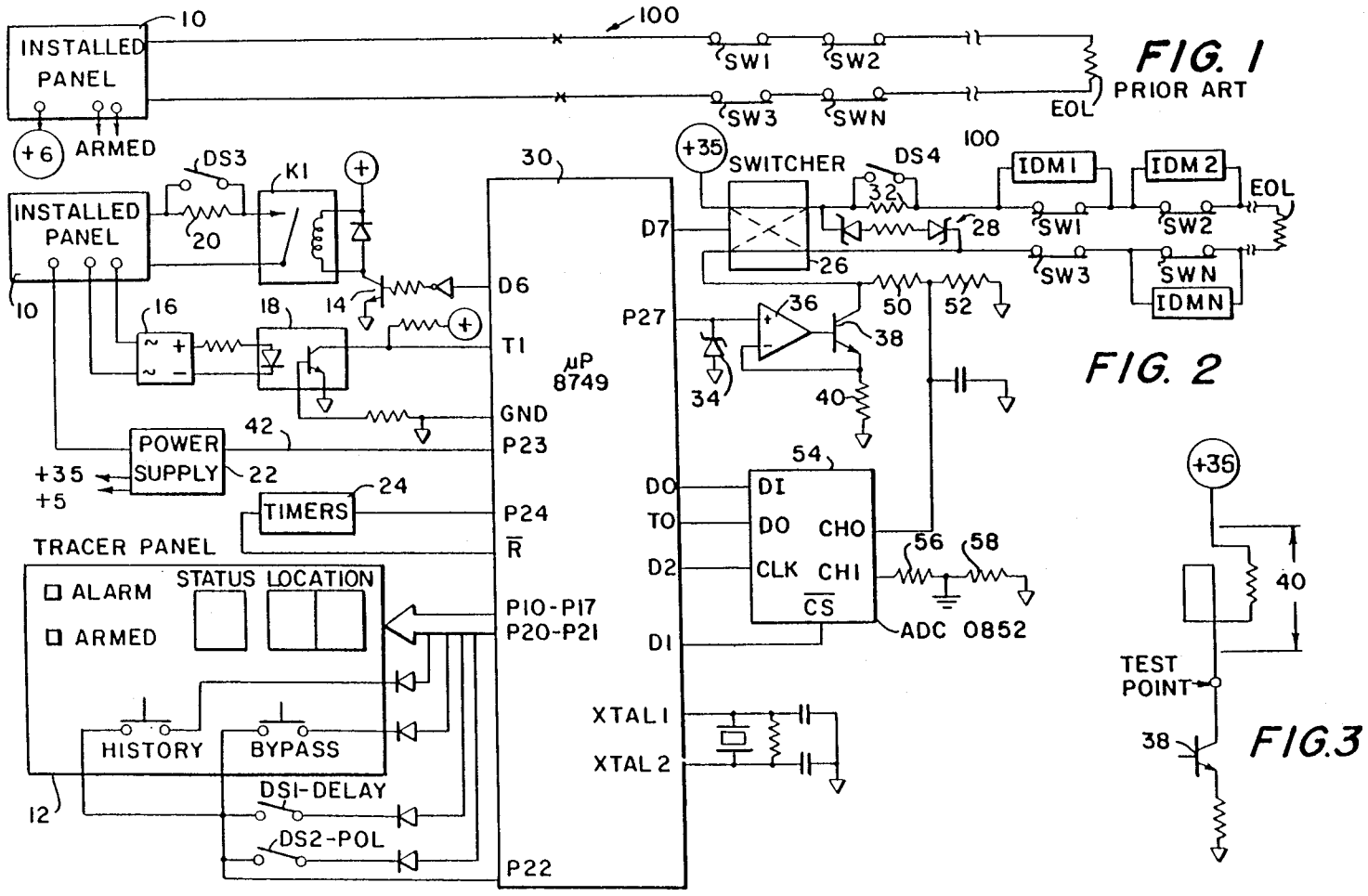
FIG. 1 PRIOR ART
FIG. 1 depicts a typical prior art single-wire loop alarm system.
FIG. 2 depicts the manner in which the prior art system can be retro-fitted in accordance with the principles of the invention disclosed in the above-identified application Ser. No. 838,595, by the addition of a central control near the installed alarm panel, and the placing of an identification module across each alarm switch which must be identified when open.
Figure 4:
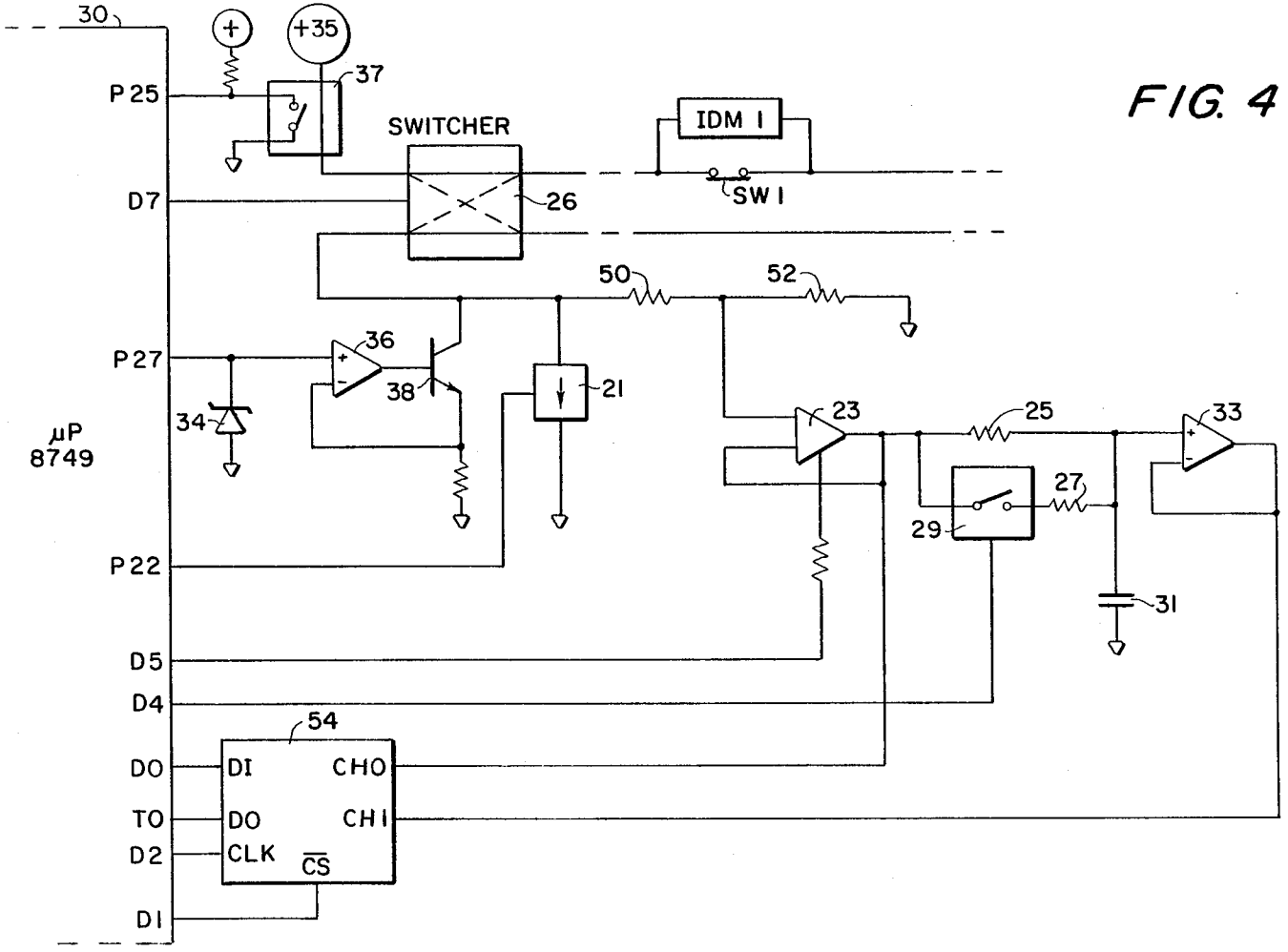
Figure 5:
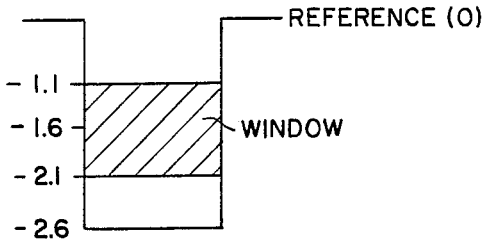
Figure 6:
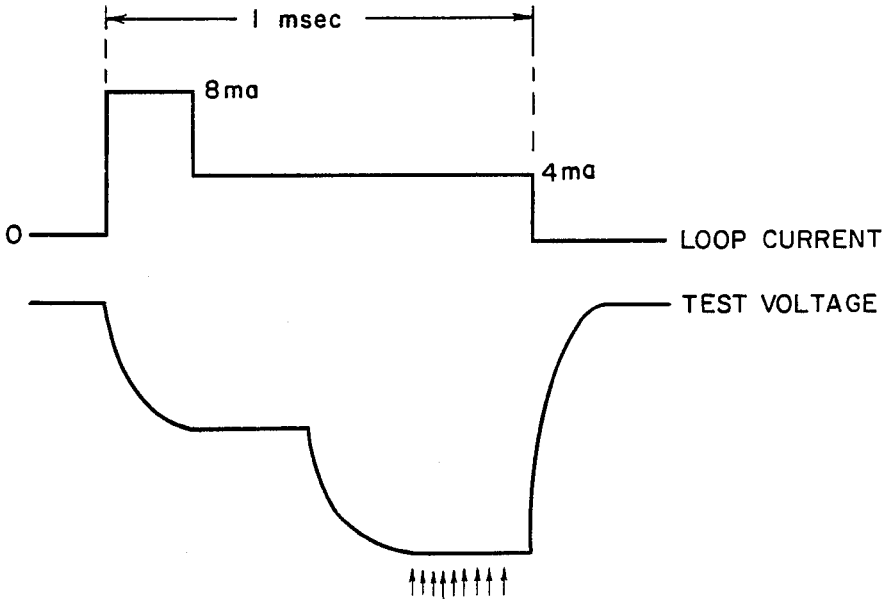

FIG. 3 will be helpful in understanding the manner in which voltage increases and decreases at the test point of the system of FIG. 2 represent different conditions of interest;

FIG. 4 depicts the illustrative embodiment of the invention by showing the changes required to the system of FIG. 2;

FIG. 5 depicts voltage levels which will be helpful in understanding the system operation; and FIG. 6 depicts current and voltage waveforms which are applicable during the interrogation of an identification module.

GENERAL SYSTEM DESCRIPTION—PRIOR ART

One of the most important advantages of the system disclosed in application Ser. No. 838,595 is that it works with the vast majority of installed alarm systems. These systems have a single-wire loop 100, as shown in FIG. 1, in which a plurality of switches SW1-SWN are placed in series. Each switch is normally closed. A low-magnitude continuous current flows through the loop as long as all of the switches are closed. The two ends of the loop are connected to an installed alarm panel 10. The panel sounds an alarm when the loop current is broken. Typically, the panel is powered by a 6-volt supply and a terminal at this supply voltage level is shown in FIG. 1 because advantage is taken of it in the system shown in FIG. 2. The conventional prior art system of FIG. 1 includes an end-of-line resistor EOL. The purpose of this resistor is to allow a shunt in the loop to be detected. If there is a shunt which diverts the current from resistor EOL, the loop voltage decreases and the decrease, when sensed, informs the alarm panel that there is a problem.

The standard system of FIG. 1 is shown with two terminals, labelled "armed," as part of the installed panel 10. Somewhere in the typical installed panel there is a pair of terminals the potential across which indicates whether the system is armed or disarmed. The potential differs from system to system; it can be AC, or DC, and its magnitude may vary. Moreover, the "polarity" of the signal varies from system to system; in some, a high signal represents an armed condition, and in others it represents a disarmed condition. Certain features of the control unit rely on arming and disarming commands being given by the user via the installed panel, and the potential appearing across the "armed" terminals in the installed panel is used to indicate to the control unit whether the user wants the system to be armed or disarmed. (A DIP switch in the control unit is set in one position or the other to indicate to the microprocessor the "polarity" of the "armed" potential.)

The standard system of FIG. 1 is also shown with two points X—X in the single-wire loop. These points are intended to depict where cuts are made in the installed system to accommodate the control unit of FIG. 2.

One of the main objects of the system of FIG. 2 is to provide a mechanism whereby an open switch can be identified readily even though it is one of many on the same serial single-wire loop. It is not that the serial loop configuration is the best possible. What is important is that most burglar alarm systems are of the single-wire loop type, and what is needed is a simple, fail-safe way to provide an "add-on" or direct replacement device for determining which of many switches in the same loop are open. In the system depicted in FIG. 2, up to six simultaneously open switches may be identified, typically in a grouping of perhaps up to 128 in the same loop.

FIG. 2 has been shown the way it is in order to get across the idea that the central control can be used in an "add-on" capacity. The standard loop of FIG. 1 is shown, together with the installed alarm panel 10. The control unit is simply inserted in the loop by cutting the single-wire loop in two places, as described above in connection with FIG. 1, and making appropriate connections. The control unit requires a 35-volt supply. In order to be able to use the 6-volt supply of the installed alarm panel if that is desired, a power supply 22 is provided for stepping up the voltage. Power supply 22 is a DC-to-DC converter. The power supply also derives a regulated 5 volts for powering the microprocessor and its associated logic circuitry.

Individual identification modules are placed across respective switches. Three such modules, IDM1, IDM2 and IDMN are shown in FIG. 2. (If any switch, such as SW3, is not shunted by an identification module, it can still trigger an alarm when opened. However, the control unit will be unable to ascertain which switch is open.) Each of the modules is assigned a respective address by programming it appropriately. The control unit interrogates all of the modules serially, and any module which is associated with an open switch responds in such a manner that the control unit is informed that the switch is open. The control unit is capable of identifying up to six open switches in each polling cycle in the illustrated embodiment.

When any switch is open, the connected identification module drops 5 volts across the switch. If it is desired to sense up to 6 open switches, there will be a total drop across the 6 switches of 30 volts. It is for this reason that a 35-volt supply is used; a sufficient voltage must be applied across the loop to allow a number of voltage drops to be sensed. A lower supply voltage for the loop would still allow the system to function, but fewer simultaneously open switches could be ascertained.

The loop, broken at points X—X of FIG. 1, is connected to the control unit of FIG. 2 as shown. One end of the loop is connected directly to switcher 26 (a solid-state double-pole, double-throw relay), and the other is connected through a resistor 32 which is bypassed or not bypassed depending upon the position of DIP switch DS4. The control unit may expect an end of line resistor in the wire loop. If one is not present, DIP switch DS4 is opened by the installer; the resistor is needed so that with the predetermined quiescent current of 2 milliamperes, a potential drop of about 4 volts will appear across the loop. The exact value of the potential drop is not important if the system self-calibrates.

The other ends of the cut wires in the loop are also connected to the control unit; the installed panel is shown connected as shown in the upper left part of FIG. 2. The 6-volt potential of the installed panel is extended directly to power supply 22 and, as described above, controls the generation of a 35-volt potential under control of the microprocessor. The "armed" potential is extended to the AC inputs of bridge 16, and the DC output is extended to optoisolator 18. The output of the optoisolator is extended to the T1 test input of the microprocessor. The Intel 8749 microprocessor has bidirectional ports; the bit positions in the ports can serve as inputs or outputs depending upon the instruction being executed. The microprocessor also has test inputs, of which T1 is one, which while not bidirectional are faster. When input T1 is tested, the microprocessor can determine whether the potential across the "armed" terminals in the installed panel is high or low. The reason for using bridge 16 is that over a wide range of inputs, the T1 input will be forced low; otherwise it is held high. A DIP switch DS2-POL is set by the installer so as to inform the microprocessor whether a high potential at the T1 input represents an armed or a disarmed condition. The installer can determine this and set the DIP switch appropriately simply by testing the potential across the "armed" terminals of the installed panel.

The terminals of the installed panel which are connected to the loop, and which are broken at points X—X in FIG. 1, are connected to the contacts of relay K1 as shown in FIG. 2. A resistor 20 simulates the end-of-line resistor. If the installed system includes such a resistor, the installed panel expects to see it in the line and DIP switch DS3 is opened. If there is no end of line resistor, the DIP switch is closed. It is in this way that the installed panel is made to "think" that it is still connected across the loop of the alarm system. As long as the microprocessor determines that there is no alarm condition, the D6 data output of the microprocessor is held low, transistor 14 conducts, and relay K1 is energized; with the closing of the relay contacts, a closed loop is simulated. When an alarm condition is sensed by the control unit, relay K1 is deenergized by causing data output bit D6 to go low. The owner of the system is given an option whether to have the installed panel informed of the alarm condition immediately upon its detection, or whether to delay informing the installed panel until the alarm condition is verified. Thus there may be a short delay between the sensing of an alarm condition and the actual opening of the simulated loop. DIP switch DS1-DELAY in the system of FIG. 2 is set by the installer to indicate whether a delay is to be tolerated while the verification sequence proceeds.

Tracer panel 12 is provided with three 7-segment LED displays. One of these serves as a "status" indicator. The other two serve to identify a "location" (module identification). The meanings of the terms are described in application Ser. No. 838,595. There are also two light emitting diodes, labelled "alarm" and "armed" on tracer panel 12; these serve the conventional functions of indicating whether an alarm condition exists, and whether the system is armed to report a break.

Also on the tracer panel 12 are two push-button switches labelled "history" and "bypass." Operation of the former causes the control unit to enter a sequence during which a serviceman is provided with a summary of the overall past performance of the system. Operation of the "bypass" push-button enables the system to be armed despite the fact that one or more switches are open, and the system will still operate properly to identify additional switches which may open and to inform the installed panel of such an alarm condition.

Port bits P10–P17, P20–P21 and P22 control all tracer panel indications, and also the reading of four switches—DS1-DELAY, DS2-POL, history and bypass. There are many ways in which this can be accomplished, and the details are not shown in the drawing since they would simply complicate the drawing and show nothing more than only one scheme of many which are known to those skilled in the art.

Timers 24 depicted in FIG. 2 serve a standard function. It is possible that a microprocessor will go "haywire" and cease to function properly. In such a case, it is necessary to reset it in the hope that proper operation will resume. The microprocessor is programmed, at the "background" level, to pulse port bit P24 at intervals of 1 millisecond. Timers 24 check that a pulse occurs no sooner than 0.9 milliseconds subsequent to the previous pulse, and no more than 1.1 milliseconds after it. As long as both conditions are always satisfied, the reset input of the microprocessor is not forced low. But if any pulsing of the timers is premature, or if 1.1 milliseconds go by without a pulse being sensed, the microprocessor is reset. This kind of "sanity" timer operation is standard in the art.

Not all of the microprocessor inputs and outputs are shown. Interrupts are not utilized, and thus the interrupt input of the microprocessor is disabled. There is no external memory necessary (the microprocessor includes sufficient ROM and RAM to accommodate all of the programming necessary to implement the system functions). The crystal connections are standard; the microprocessor is run at a clock rate of 11 MHz. The only other inputs and outputs of the microprocessor which must be considered are data bits D0, D1, D2 and D7 (all used as outputs only), test input T0, and port bit P27 which is used as an output.

Port bit 27 is connected to the plus input of voltage follower 36. Zener diode 34 serves to apply a constant potential to this input of the voltage follower when the port bit is high. The feedback arrangement which connects the emitter of transistor 38 to the minus input of the voltage follower causes the two inputs of the voltage follower to be at the same potential. Thus the feedback arrangement causes the voltage across resistor 40 to be the same as that across the Zener diode. This, in turn, means that the current which flows through resistor 40 and transistor 38 is determined by the ratio of the voltage of the Zener diode and the impedance of resistor 40. The current which flows through transistor 38 comes from the loop, as seen in FIG. 2. Resistors 50 and 52 are relatively large in magnitude compared with resistor 40 and thus draw relatively little current. The loop current in the quiescent condition is 2 milliamperes and almost all of it flows through transistor 38. When the microprocessor causes transistor 38 to turn off, the loop current ceases.

Alarm conditions as well as module identifications are determined by sensing the potential across the loop. One end of the loop is held at 35 volts, and the other end of the loop will be at the same potential if all of the switches are closed (in the absence of the EOL resistor). Resistors 50 and 52 serve to divide down the voltage; the resulting voltage at the input of programmable comparator 54 is sensed and indicates the loop condition. It is when the potential changes that there is an indication that a switch is open or that an identification module is responding to a poll. For each switch which is open, the junction of the collector of transistor 38 and resistor 50 is less than 35 volts by 5 volts. During the polling process, whenever an identification module which is across an open switch is interrogated, it causes the potential across the loop to increase momentarily by 2 volts and this is detected by the programmable comparator 54.

The function of the programmable comparator is that of an analog-to-digital converter; it senses the analog voltage at the junction of resistors 50 and 52, and furnishes a digital representation to the microprocessor. An A/D converter is not used, however, because it would be too slow. Instead, a National Semiconductor ADC 0852 programmable comparator is used. The comparator is connected to the microprocessor by three inputs, and one output. The three inputs from the microprocessor are D2 (used to clock the comparator), D0 (used as the serial data input to the comparator), and D1 (used as a chip select); the comparator is set to an analog threshold level in accordance with a serial data code which is transmitted by the microprocessor. Once the analog level is set, the comparator compares it with the potential at the junction of resistors 50 and 52. The output of the comparator, DO, which is connected to the T0 test input of the microprocessor, informs the microprocessor whether the sensed potential is above or below the threshold which was previously set.

The test voltage at the junction of resistors 50 and 52 is applied to the CH0 input of the comparator. The comparator has two ports CH0 and CH1, and the potential at either one can control the level of the D0 output. The state of the channel select input determines which channel is operative and this, in turn, is determined by the data loaded into the comparator via the D0 output of the microprocessor. The chip select input of the comparator is used to enable the comparator or to reset it.

The channel 0 input is the "main" input in the sense that the potential at this input reflects the present state of the loop. Channel 1 is used for another purpose. It will be noted that while the right end of resistor 58 is connected to the circuit ground, the junction of resistors 56 and 58 is connected to earth ground. Thus the potential at the junction of the two resistors, which is sensed at the channel 1 input and is a measure of the potential relative to the circuit ground, is the difference between the earth and circuit ground potentials. If the earth and circuit grounds are different, it is an indication that the wire loop is shorted somewhere to earth ground.

Switcher 26 serves to connect the two ends of line 100 to the 35-volt potential or the collector of transistor 38 in one of two different polarities, depending on the state of output bit D7 of the microprocessor, so that current can flow in either direction through the loop. The switcher is a standard electronic element which simulates a double-pole, double-throw switch. The protection circuit 28, comprising a resistor and two back-to-back Zener diodes, simply serves to protect the system against large voltages which may arise in the loop as a result of lightning and the like. If the potential across the loop exceeds a threshold value, one of the Zener diodes conducts and prevents a large potential from being extended to the collector of transistor 38, or from developing across an IDM whose switch is open.

The representation in FIG. 3 will permit a very brief description of the manner in which the loop condition can be sensed in accordance with the potential at the collector of transistor 38. It will be understood that the actual potential which is monitored is that which is at the junction of resistors 50 and 52, but the potential at the collector of transistor 38 is a "test point" in the sense that all information about the loop can be derived from its value. If the loop is operating properly, there is typically a 4-volt potential across it. All of the switches are in effect short circuits, and if the EOL resistor has a magnitude of 2 kilohms, the 2-milliampere current in the line causes a 4-volt drop. Thus the test point is at a potential of 31 volts. An increase in the potential at the test point is an indication that the voltage across the loop has decreased; the drop across the loop is less than 4 volts. This is an indication of a short across the line, the EOL resistor somehow being shorted out of the loop. On the other hand, a decrease in the test point voltage results from an increase in the potential across the loop. This can arise in two ways. Either the loop itself is completely open (in which case the test point voltage drops to ground), or one or more switches are open, in which case the additional drop within the loop causes the voltage at the test point to be lower than the quiescent 31 volts. In the latter case, a scanning sequence ensues, and whenever an identification module responds to a query, the drop across it decreases. This means that the drop across the loop decreases and the potential at the test points increases. It is a potential increase at the test point during the scanning sequence that is an indication of a response by the module being addressed.

The use of a programmable comparator in the manner described is important. It would be possible to use a conventional-type analog-to-digital converter to check the loop voltage. However, in order to operate at a satisfactory speed, as will become apparent below, there are no more than about 50–100 microseconds to repeatedly examine the potential at the collector of transistor 38. This would necessitate the use of an expensive "flash" analog-to-digital converter. A programmable comparator, on the other hand, requires a relatively long time to set up, but its response time is in the order of only one microsecond; moreover, it is an inexpensive device. Because the alarm loop is in effect an antenna, there is a considerable amount of noise on it, and the potential at the test point must be "debounced." In other words, the potential at the test point, while for most of the time on one side of a threshold level, can actually exceed the threshold in the other direction momentarily. One way to compensate for this is to take multiple readings and to form an average of the results. A programmable comparator allows a reading to be taken in about one microsecond, so that even multiple readings can be taken in a very short time.

The manner in which an identification module operates is not discussed herein, other than its effect on the overall system. Similarly, those parts of the system of FIG. 2 which are not necessary for an understanding of the present invention are not described. Reference may be had to the above-identified application Ser. No. 838,595 for a complete description of the system. The remainder of this description will pertain to the system changes depicted on FIG. 4.

GENERAL DESCRIPTION OF THE INVENTION

A first problem with the system of FIG. 2 concerns the identification of an alarm condition. The minimum change in loop potential when an alarm condition exists is described above as five volts, the drop introduced by a module across its associated alarm switch when it is open. The system of FIG. 4 uses components of different values; also, depending on the integrated circuit fabrication technology, potential drops may differ. A module used with the system of FIG. 4 introduces a drop of 2.6 volts when it is powered. In order to detect a change of 2.6 volts, a threshold level in the order of 75% of this value is used; any change less than 1.95 volts is not considered to represent an alarm condition, and any change greater than 1.95 volts is interpreted to represent the opening of at least one switch. (A change of 4.5 volts, for example, represents the opening of two switches.) It is thus apparent that noise which introduces a potential drop across the loop in the order of as little as two volts can give rise to a false alarm condition. The problem is not unique to the system described. It is a problem generally encountered in the alarm system field, but it is of concern nonetheless.

The traditional solution to this problem is to use some form of integration. In a conventional DC loop, an RC circuit allows the recognition of only long-term changes. Short transients are not detected. In prior art multiplexed systems, in which different loops are examined at different times, the integration can be accomplished in software. Unfortunately, the conventional integration techniques—hardware or software—are not suitable for the subject alarm system. The reason has to do with the way in which the identities of the open switches are determined after it is first established that there is an alarm condition.

The system relies on the programmable comparator to recognize an identification module which responds during the polling sequence. When a module which is across an open switch is polled, its voltage drop reduces from 2.6 volts to 1.6 volts. The comparator monitors the loop voltage and its output represents whether the loop voltage is above or below a threshold level, e.g., 2.1 volts, which has been programmed. It takes a relatively long time to set the threshold level, but the response of the comparator is very fast. In order to poll all of the identification modules in the loop, a device must be provided which can respond rapidly to a potential change. It is far better to spend extra time setting up the threshold level in the comparator before a polling sequence, but to have the comparator respond instantaneously to a potential change caused by a module when it is interrogated. To use a hardware integrator would completely negate the advantage of the comparator approach because the comparator could not respond rapidly to potential changes. (This is especially true if, for verification purposes, each identification module is queried several times in succession; this would require several successive rapid changes in potential which would have to be detected.) Software integration also offers an inadequate solution; it requires successive determinations of the value of the loop potential, as opposed to simply comparing the loop potential with a preset threshold. Expensive analog-to-digital converters are not practical for use in home alarm systems. The comparator approach is used in the first place because of its low cost advantage. Using a comparator for determining the value of the loop potential would require successive settings of threshold values, for example, using a binary search routine. The time involved would be excessive.

The solution to this problem is to use an analog integrator, but on a selective basis. The comparator has two channels. The loop potential is applied to both channels, but it is fed to one of them through an RC network that provides a 10-millisecond integration time constant. This slow channel is used for all loop monitoring functions which are not time critical. This includes the sensing of a change in loop potential indicative of an alarm condition. There is no polling underway at this time, and a short delay in sensing a change in loop potential is of no importance. The slow channel is also used when it is necessary to actually measure the value of the loop potential, using a binary search or other scheme. The fast channel is used only when the response time is critical—during a polling sequence. Once it is known that an alarm condition exists, all of the identification modules have to be queried in order to find out which switches are open. This is the time-consuming sequence, and things are made even more complicated by the fact that each identification module is actually queried several times in succession (a "majority vote" is required) in order to make sure that a valid response is obtained.

This solution is not perfect, however, and it gives rise to the second problem—the effect of long-duration noise transients. Even with a slow response which in effect cancels out short-lived noise, long-duration noise can still cause false alarms. The noise appears as a voltage superimposed on the loop, and integration cannot cancel it if its duration is long compared with the integration time constant. Increasing the time constant to filter out long-duration noise would slow the normal alarm response time beyond acceptable limits.

The solution to this problem is to determine whether a voltage change across the loop, after it is sensed, is due to noise or due to an alarm condition.

In the illustrative embodiment of the invention, a 4-milliampere loop current flows. Whenever a switch opens, there is a 2.6-volt increase in the loop voltage. This means that the identification module has an effective impedance of 650 ohms. When an alarm condition is sensed (by the loop potential exceeding the threshold level), the control unit increases the current from 4 milliamperes to 8 milliamperes and measures the loop voltage again. If the source of the potential increase was resistive, i.e., it was due to the effective impedance of an identification module, the voltage change from the quiescent condition should be equal to 5.2 volts. [In the event there are multiple open switches, the potential change should still be double.] On the other hand, if an increase in the current does not cause the voltage to increase linearly, the source of the original voltage increase is not resistive and must thus be noise-induced; in the latter case, it is assumed that there is no alarm condition.

The third problem pertains to answerbacks from the modules during polling. For an understanding of the problem, and its solution, it will be helpful to consider illustrative potentials. The control unit measures the voltage drop across the loop. (This can be accomplished using a binary search routine, and time is not critical in the absence of an alarm condition.) A 35-volt potential is applied to one end of the loop. It is the potential at the other end (see FIG. 3) which is connected to the comparator input through slow and fast channels. The potential which is actually monitored and compared with the threshold set in the comparator is 35 volts minus the drop across the loop. All changes are relative to this quiescent potential. When an alarm switch first opens, and the connected identification module develops 2.6 volts across its terminals, the potential at the end of the loop connected to the comparator drops by 2.6 volts. Polling then begins. Assuming that only one switch is open, the potential at the input of the comparator will remain 2.6 volts below the quiescent level as long as the identification module being queried is not connected across the open switch. But when the identification module being queried is the one across the open switch, the drop across it is reduced from 2.6 volts to 1.6 volts. This means that the potential at the input to the comparator rises by 1 volt.

All potential changes when an alarm condition first arises and during polling are relative to the quiescent level, and thus all threshold values set in the comparator are also relative to the same quiescent level. For ease of analysis, it is more convenient to consider all threshold levels and all potential changes at the comparator input to be relative to zero volts as shown in FIG. 5. All the potentials to be considered are negative because an open switch, whether it is being polled at the time or not, introduces a drop in the loop, which, in turn, means that the potential at the non-supply end of the loop, the end which is connected to the comparator, has a potential which is negative relative to the quiescent level.

Using relative levels as just described, the opening of one or more switches will result in a drop in potential at the input to the comparator of at least −2.6 volts (double that if two switches are open, etc.). The threshold is set to 75% of the expected voltage drop. Thus, the comparator threshold is set at −1.95 volts relative to the quiescent level. As soon as the potential at the input to the comparator is greater than −1.95 volts, it is an indication that there is at least one open alarm switch. (With reference to FIG. 5, −1.6 volts, for example, is greater than −2.6 volts.)

As the various identification modules are polled, there is no change in potential until the address of the module across the open switch appears on the line. That module responds by decreasing the drop across its terminals. The voltage across the module decreases from 2.6 volts to 1.6 volts. This means that the potential at the comparator input relative to the reference level should go from −2.6 volts to −1.6 volts. A threshold level of −2.1 volts is selected in order to determine that the transition took place. Thus during the polling sequence, the threshold of the comparator is −2.1 volts relative to the reference level. It is here that the problem arises. If there is noise on the line which is greater than 0.5 volts in amplitude, the test potential will increase from −2.6 volts to a level above −2.1 volts even if the module being polled is not the one across the open switch, and the wrong switch will be identified as being open. The polling must be fast and the integrator with a relatively long time constant cannot be used to cancel the noise.

The solution is to require a different type of overall test to be passed. If the test (comparator input) potential is greater than −2.1 volts, a new threshold level is used, −1.1 volts, as depicted in FIG. 5. The response from the module being queried is now verified by checking that the test potential is more negative than −1.1 volts. The test potential resulting from an answering module should be about −1.6 volts. If the test potential is greater than −2.1 volts and less than −1.1 volts, the test potential is within 0.5 volts on either side of what it should be when a module responds to a query. The noise immunity is improved by providing a window, rather than a threshold, for the comparator to examine. It is much less likely that noise will appear at exactly the right amplitude, within both limits of the window.

The actual sequence in the illustrative embodiment of the invention is a bit more complicated than that just described. During a polling sequence, each identification module is queried for 1 millisecond. Nine successive comparisons are performed during this interval. The first three are performed with a threshold level of −2.1 volts. If two of the three tests (a majority vote) apparently result in an answerback, with the test potential being greater than −2.1 volts, then it is an indication that there may be a legitimate answerback in progress. Only then is the threshold level set to −1.1 volts and another three comparisons performed to see if the test potential is more negative than −1.1 volts. A majority vote is also taken on the second group of three tests. If the answer is affirmative, it is an indication that the test potential is within the window which is expected when a module is responding to a query. Only then are the last three tests performed, once again on a majority-vote basis. For these last tests, the threshold level is set once again to −2.1 volts, and the test potential must once again be greater than the threshold level.

The reason for the third group of three tests is to guard against noise which causes the test potential to decrease continuously during the course of the 1-millisecond overall test cycle. As the test potential becomes more and more negative, both of the first two groups of tests will be passed. During the first group of tests, while the threshold level is set at −2.1 volts, the test potential might be at a level (for example, of −0.9 volts) greater than −2.1 volts, thus resulting in a pass. During the second group of tests, the test potential might be at −1.7 volts, a potential more negative than the threshold of −1.1 volts and thus resulting in another pass. But by the time the third series of tests is performed, once again with a threshold of −2.1 volts, the test potential may have gone to −2.5 volts as a result of the noise which causes the potential to change in only one direction. Consequently, the third group of tests will be failed and the control unit will not erroneously think that the module now being queried is placed across an open switch.

In theory, by requiring a window test to be passed, and especially by requiring three majority votes all involving opposite extreme limits in the manner described, the system is relatively immune to noise even in the absence of integration. However, there is a very real practical problem, and it pertains to switching of a threshold level twice during each 1-millisecond cycle, first from −2.1 volts to −1.1 volts, and then back to −2.1 volts. Three readings are taken for each test level for "debouncing" purposes; a majority vote is required because it is recognized that any individual reading may be the result of noise. Even a very fast analog-to-digital converter requires in the order of 25 microseconds to perform an 8-bit conversion. Even if the 8-bit result is read in parallel by the microprocessor which controls the system operation, the three tests in each group still require in the order of 100 microseconds. To perform three groups of tests would require about 300 microseconds. While this is only 30% of the 1-millisecond cycle time, the microprocessor has much more to do. Especially using an Intel 8749 which is short on computational capabilities, there is insufficient time to perform nine tests and process the results during a 1-millisecond cycle, even were an expensive analog-to-digital converter to be used. All of the mathematics involved in averaging readings in order to perform the debouncing function is avoided by using a comparator, setting a threshold level, and then seeing if a particular test is passed two out of three times. What are involved here are bit manipulations, not arithmetic. Also, the comparator is a very fast device, once the threshold is set. The problem is in setting the threshold. The comparator which is used in the illustrative embodiment of the invention (ADC 0852) has its threshold set by applying a series of bits on a serial line. The comparator is quite inexpensive, but it requires on the order of 400 microseconds to set a threshold level. While a comparison can be performed in just a few microseconds, using this device it would not be possible to set two threshold levels, as well as to take nine readings and digest the information, all in a 1-millisecond cycle.

The solution to this problem is to set the threshold level of the comparator only once at the beginning of the overall polling sequence, but to switch the effective threshold twice during each 1-millisecond cycle in another way. The test potential is fed to the comparator through a buffer amplifier. A typical buffer amplifier is provided with an "offset" pin. A potential is usually applied to the pin in order to allow the output to be zeroed when the inputs are shorted together. It is this offset pin which is used, but for a completely different purpose. One of the data bits outputted by the microprocessor is applied to the offset pin of the buffer amplifier. In effect, it causes the output of the amplifier to shift the test potential at the input. Since the comparator simply functions to compare the potential at its input with the threshold level which is stored in it, shifting the input by one volt is equivalent to changing the threshold level by one volt. Instead of changing the threshold level which requires hundreds of microseconds, the equivalent shifting of the input is accomplished almost instantaneously simply by changing the offset of the buffer amplifier.

THE ILLUSTRATIVE EMBODIMENT OF THE INVENTION—FIG. 4

The hardware changes required to the system of FIG. 2 are relatively minor, and only that much of the illustrative embodiment of the invention is shown in FIG. 4 as is necessary for an understanding of the changes.

As shown in FIG. 2, microprocessor port bit P27 controls the turning on and off of a 4-milliampere current through transistor 38. The same thing is true in the system of FIG. 4. But the system of FIG. 4 includes another 4-milliampere current source, shown only symbolically by the numeral 21, controlled by another microprocessor port bit, P22. Either no current flows through the loop, or there flows a current whose amplitude is 4 milliamperes or 8 milliamperes.

In the system of FIG. 2, the junction of resistors 50 and 52 is connected to channel CH0 of comparator 54. A similar connection is shown in FIG. 4, except that there is an intermediate buffer amplifier 23. The amplifier serves two functions. First, it converts the high impedance seen looking into the junction of resistors 50 and 52 into a low impedance seen looking into the output of the amplifier. The second function of the amplifier is that it controls a change in its output level of one volt depending upon whether the offset pin is energized; the offset pin is controlled by microprocessor data bit D5. It is data bit D5 which determines whether comparator 54 is looking for a potential which is greater than −2.1 volts or less than −1.1 volts. Instead of changing the threshold of the comparator, a single threshold can be used throughout the polling sequence. That threshold can be set to −1.1 volts or −2.1 volts. The other threshold is effectively brought into play by causing the output of amplifier 23 to shift by one volt. When the offset is applied, if a module is answering back the output of the comparator should change state; the software now considers an output of opposite polarity to be a pass. It is this feature which facilitates the window test, a test which is most effective in guarding against the effects of higher frequency noise transients (transients greater than 1 volt in amplitude and having a width up to about 200 microseconds).

Channel CH0 of the comparator is the fast channel because the loop potential at the junction of resistors 50 and 52, after passing through buffer amplifier 23, is applied directly to the channel input. It is channel CH1 which is used as the slow channel—not because there is anything different about the two channels from the point of view of the comparator, but rather because the input to channel CH1 is derived through an integrator which has a 10-millisecond time constant. Switch 29 is controlled by microprocessor data bit D4. The switch is normally open. The output of amplifier 23 is connected to the input of buffer amplifier 33 through an integrator which includes resistor 25 and capacitor 31. The integrator provides a 10-millisecond time constant. Thus when switch 29 is open, the test potential of the loop is applied directly to the fast channel of the comparator (with an offset voltage which can be shifted rapidly), or to the slow channel through a 10-millisecond integrator. When switch 29 is closed and resistor 27 bypasses resistor 25, the time constant of the integrator is much shorter because resistor 27 is much smaller in magnitude than resistor 25. The reason for this feature will be described below.

There are two other changes. Referring to FIG. 2, it will be noted that there is a capacitor which connects the junction of resistors 50 and 52 to ground. This capacitor was provided to eliminate narrow spikes of a few microseconds in duration. The slew rate of buffer amplifiers 23 and 33 in FIG. 4 is about 5–10 microseconds, so there is no longer a need for the capacitor.

The other change relates to the circuit connected to channel CH1 in FIG. 2. It will be recalled that resistors 56 and 58 provide an input to the second channel of the comparator which represents the difference between earth ground and circuit ground. Channel CH1 of the comparator is used in the system of FIG. 2 to detect a shorted line. That arrangement is not used in the system of FIG. 4 primarily because channel CH1 of the comparator is used to monitor the integrated loop test potential. Another mechanism is provided in the system of FIG. 4 for sensing a shorted line. The 35-volt supply powers the line, but the actual current which flows through the line is determined in accordance with how many of the two 4-milliampere current sources are turned on. During proper operation, the loop current is limited by the magnitude of the current sink. However, if any part of the line is shorted to ground, much more current will flow; the current is not limited by the amount which is drawn by the sink. In such a case, sensor 37 causes its internal switch to close; this switch responds to a current which exceeds a threshold level, in this case a current which exceeds 8 milliamperes by a safe margin. Port bit P25 senses the switch closure when the switch is interrogated, the microprocessor thus determining that the loop is somewhere shorted to ground.

ADDITIONAL CONSIDERATIONS

It is apparent that the hardware changes which must be made to the system of FIG. 2 in order to derive the system of FIG. 4 are relatively minor. Much of the circuit operation has been described above. However, there are other features controlled by the microprocessor which require additional description.

There are two other problems which can be solved by using the components which are added to the system of FIG. 2, as shown in FIG. 4. One of these problems relates to 60-Hz signals which may be induced on the loop. In extreme cases, a 5-volt peak-to-peak signal can appear in a loop. The 60-Hz signal modulates the loop voltage and makes detection of an answerback by voltage measurement very difficult. The other problem relates to the fact that current in the loop of FIG. 2 is turned on and off at a 1-millisecond rate. The alarm loop may represent a parasitic capacitance approaching 0.1 uF (including capacitance between loop wires and capacitance to ground). With loop resistance approaching 5K, the charging time exceeds the 1-millisecond time interval of the entire cycle. In other words, while in theory sharp current pulses appear in the loop, with the current magnitude changing abruptly between zero, 4 milliamperes and 8 milliamperes, what might happen in actual practice, if not guarded against, is that the voltage across the loop will change exponentially and will not reach the desired level even before the current sources are switched.

In the system described in application Ser. No. 838,595, the quiescent loop voltage is determined prior to each polling cycle. As described above, the threshold level which is set in the comparator is 1.95 volts less than the quiescent level while the system is waiting to see if an alarm condition exists; once an alarm condition is detected, the threshold level which is set in the comparator, and which remains there for the duration of the polling sequence, is 1.1 volts or 2.1 volts less than the quiescent loop voltage. The problem with 60-Hz signals or other low-frequency noise appearing on the line is that the instantaneous loop voltage will be modulated by the noise. The comparator will see voltages that satisfy the window requirement even if there is no answering module because the 60-Hz modulation may be slow enough to meet the window criterion. Conversely, an answering module may be ignored if the AC component of the loop voltage pushes the voltage at that instant outside the window.

The solution to this problem is to acquire the reference voltage from which the threshold is displaced not once for every complete polling sequence, but rather once for each cycle; a separate reference voltage is derived for each module which is interrogated. Low-frequency noise is not a problem unless it shifts the loop voltage by more than 0.5 volts (the window limit in each direction around the −1.6-volt answerback level) within the several hundred microseconds that are required between acquisition of the threshold and analysis of the answer.

In the system of FIG. 2, a responding module causes the voltage drop across it to be lowered for the duration of the 1-millisecond interrogation cycle. In the system of FIG. 4, half of each cycle is used to derives the reference potential, and the other half is used to see whether the module answers its poll by changing the loop voltage. Referring to application Ser. No. 838,595, there is shown in FIG. 4 a resistor 118 which controls for how long the module lowers the potential across its input terminals when it is polled, if it is connected across an open switch. By halving the value of that resistor, the module will respond for only 500 microseconds, not 1 millisecond. During the first 500 microseconds the control unit stores the loop potential controlled by answerback of the module (nominally, no change from the reference, or a 1-volt increase). During the second 500 microseconds of each cycle, the control unit acts upon the loop potential which exists when the module is not responding; nominally, and referring to FIG. 5, this potential is −2.6 volts. It is during the second half of the cycle that the comparator compares the stored module "response" potential with the reference potential by performing the nine tests described above. In this way, 60-Hz variations make no difference, as long as they do not cause a change in potential which approaches 0.5 volts between the time that the loop voltage is determined while the module is answering back, and the end of the cycle while it is known that the module is not.

It might be thought that it would be more logical to store the reference potential first, and then to compare it with the loop potential as the module is answering back during the second part of each 1-millisecond cycle. Yet what is preferred is to store the answerback potential first, and then compare it with the reference potential. It makes no difference from a processing point of view which potential is considered first and which second. The reason that the answerback potential is stored is that it is easier to cause the module to respond immediately when it is polled, and to stop the response after 500 microseconds; the alternative would be to provide two separate timers—one to delay the response, and the other to time the duration of the response.

The big question, however, is how to do any processing with a reference potential which is taken during every cycle when a basic thesis of the system design is that the comparator does not allow voltage measurements, but rather only quick tests whether the loop potential is above or below a threshold level.

The answer relates to switch 29. The comparator can be programmed to work in a differential mode, and it works this way during polling. What is compared to the threshold (0.5 volts) set in the comparator is the difference between the potentials at the CH0 and CH1 inputs. Instead of using a binary search to determine the actual loop potential in the absence of a responding module, the loop potential in the absence of a responding module controls the potential at one of the comparator channels and the loop potential controlled by a queried module is applied to the other channel; in this way the loop potential controlled by a module can be compared with a reference taken within a few hundred microseconds. The technique involves the use of an adaptive reference.

When switch 29 is closed, resistor 27 shorts out resistor 25. Resistor 27 has a magnitude of 175 ohms, as compared with resistor 25 which has a magnitude of 470K. With switch 29 closed, for all intents and purposes the instantaneous loop potential appears across capacitor 31 and at the input of channel CH1. This is the potential controlled by a queried module, nominally, no change superimposed upon the quiescent potential if the module being interrogated is not across an open switch, or +1 volt superimposed on the quiescent potential if the module being interrogated is across an open switch. In the middle of the 1-millisecond cycle, switch 29 is caused to open. By this time the module no longer responds. What appears at the input of channel CH0 is now the test reference potential without any module possibly causing a 1-volt difference. Capacitor 31, however, does not allow the voltage across it to change instantaneously. In fact, the capacitor may start to charge due to the 470K resistor that now feeds it, but the time constant is so slow (10 milliseconds) that the potential across the capacitor does not change materially over the next few hundred microseconds. (The circuit is not really of the sample-and-hold type, but rather of the sample-and-drift type.)

The microprocessor examines the comparator output 9 times during the last half of each cycle. It is at this time that what is looked at is the difference between the test (reference) potential when no module should be responding and the test potential when the interrogated module is responding, if it is. It should be noted that it makes no difference how many modules are across open switches. In FIG. 5 it is assumed that only one switch is open, and that a module introduces a 1.6-volt drop in the loop when it is responding to a poll, and a 2.6-volt drop when it is not. Suppose that there are three modules that are connected across open switches. Together they introduce a 7.8-volt drop in the line. Whatever the potential initially stored across capacitor 31, only one module could possibly have responded during the first half of the 1-millisecond cycle. Consequently, the potential which will appear at the input of channel CH0 will be at most 1-volt more negative during the second half of the cycle. The threshold level which is set in the comparator at the start of the overall polling sequence is 0.5 volts. The threshold is 0.5 volts less than the difference (1 volt) between the two channel potentials, or it is 0.5 volts higher than the difference (zero) when a queried module does not respond. The 1-volt offset technique, controlled by data bit D5 during the second half of each cycle, allows tests at opposite extremes of the window while using the same threshold level.

Referring to, FIG. 6, there are shown the loop current and the test voltage during a module scan cycle. Ignoring for the moment the initial 8-milliampere pulse which is shown at the beginning of the 1-millisecond interval and which has not been explained thus far, the loop current is shown as 4 milliamperes. This is the current which flows when a module is being interrogated. (The loop current ceases completely for 1 millisecond between successive module interrogations.) During the first half of the cycle, the test voltage is controlled by the queried module and it may be 1 volt higher than the reference potential (not yet determined) or equal to it. During the second half of the cycle, the test voltage is the reference potential, the potential in the absence of a module response. Nine short vertical arrows are shown on the test voltage waveform. These represent the times when the microprocessor examines the output of the comparator. Shifts between the high and low limits of the window are controlled by data bit D5 which causes the output of amplifier 23 to be offset by one volt. The waveform of FIG. 6 assumes that a module is responding and that is why the potential during the second half of the cycle is less than the potential during the first half, ostensibly by 1 volt. Should the module not be responding, then the potential would remain at the same (lower) level during the entire interrogation cycle.

During the second half of the cycle, amplifier 23 has an offset voltage applied to its output in order to control effective window limits. During the first three samplings of the comparator output, the offset voltage is not applied. The comparator threshold is set at 0.5 volts. If a module is responding, the comparator should indicate that the difference between the channel potentials (1 volt) is greater than the threshold (0.5 volts). During the next three sampling times, data bit D4 causes the output of amplifier 23 to increase by 1 volt. Now the two channel potentials should differ by less than the same 0.5-volt threshold which is set in the comparator; the output of the comparator should change state. During the last three sampling times, when the offset voltage is not applied, the comparator output should revert to its first state.

Referring once again to FIG. 6, it is important that by the middle of the cycle the potential across capacitor 31 reflect the potential drop across the loop caused by an answering module if the module being interrogated is across an open switch. A module which does not respond should theoretically cause the test voltage to be at its most negative level throughout the 1-millisecond interrogation interval because the module being queried, even if it has a 2.6-volt drop across it, does not change the drop when it is being interrogated. Because of the parasitic capacitances described above, however, the test voltage waveform may not be what is expected. When a 4-millisecond current pulse is applied to the loop after a 1-millisecond interval during which no current is applied, for a non-responding module the test voltage should drop to its lowest level, and it should do so quickly at the beginning of the cycle or else there will be an apparent difference in potential during the two halves of the cycle. However, the parasitic capacitances cause the voltage to drop exponentially. This means that the voltage is higher during the first half of the cycle than it is by the end of the cycle. If by the middle of the cycle, when switch 29 opens, the potential across capacitor 31 is midway between the two limits, a module "response" will be detected even though there is none. (In a scheme in which the adaptive reference is taken during the first half of the cycle, this kind of effect results in spurious answers.) What is necessary is somehow to avoid the delaying effect of the parasitic capacitances of the loop.

This is achieved in a preferred embodiment of the invention as shown in FIG. 6—by applying an 8-milliampere current pulse at the very beginning of the cycle, and only then switching to the 4-milliampere current which is used for the actual interrogation. The reason that an 8-milliampere current pulse is used is that the system of FIG. 4 is already provided with two 4-milliampere current sources for alarm verification, and thus an 8-milliampere current pulse can be derived readily. The additional current is turned on for a period of time that will just charge the parasitic capacitances. The amount of time required is determined at the start of each new scan routine. What is actually done is to measure the loop time constant which is a function of both the capacitance and the loop resistance. Once the loop time constant is determined, the duration of the 8-milliampere current pulse during each scan cycle is set so that the effect of the parasitic capacitances is minimized. It is a relatively simple task to determine the loop time constant at the beginning of a new scan routine. The DC loop voltage is first measured, using a relatively slow 8-step binary search sequence, while a steady-state current of 4 milliamperes is made to flow through the loop. The comparator threshold is then set to 63% of that voltage, and the loop current is turned off for one millisecond to allow the capacitance to discharge. The loop current is then switched on and a timer in the microprocessor is started. The timer is stopped when the loop voltage reaches the threshold of 63%. The timer value represents the time constant of the loop.

Of course, this rather sophisticated technique need not be employed unless the system is to be pushed to its limit—when it is desired to be able to scan the maximum number of modules in whatever is the maximum time allotted for a scanning sequence. In the absence of such constraints, it is not necessary to force the loop potential to stabilize rapidly when an interrogation current starts to flow. Similarly, if noise is not a problem, the adaptive reference technique need not be employed and the comparator may simply be set to a threshold level which is measured at the start of each overall scanning sequence. On the other hand, the adaptive reference technique of our invention can be extended. For example, there is a growing concern for more data handling capabilities in smoke detector systems (not necessarily only single-loop). Instead of a two-value answer, the central control could advantageously process a multi-value or analog response. To convert an analog transducer value at each smoke detector into a digital value and to then transmit it to the central control is both costly and time consuming. In our invention, an analog value is transmitted as the answer to a query; the transducer is thus relatively inexpensive and the answer is at very high speed. The adaptive reference technique, by which an answer and the determination of the reference occur during each cycle, allows reliable, inexpensive and fast monitoring to be achieved. The technique is applicable to multi-value responses; the only difference is that the transducer must apply a multi-value impedance in the line when it responds, but that presents no difficulty. A smoke detector, for example, can readily be made to vary an impedance with the smoke level.

Although the invention has been described with reference to a particular embodiment, it is to be understood that this embodiment is merely illustrative of the application of the principles of the invention. For example, the techniques described are not limited to a single-wire loop configuration, and they have application even to parallel systems. Thus numerous modifications may be made in the illustrative embodiment of the invention and other arrangements may be devised without departing from the spirit and scope of the invention.

We claim:

1. In an alarm system having a control unit; a wire loop whose two ends terminate at said control unit; a plurality of alarm switches disposed along said loop; a plurality of identification modules connected in parallel with respective ones of said alarm switches; means in said control unit for causing a direct current to flow through said loop and for checking a signal indicative of the voltage drop across said loop to ascertain if an alarm condition exists; means in said control unit responsive to the existence of an alarm condition for generating a series of address codes in the loop to address said identification modules individually; each of said identification modules including means responsive to its individual addressing for changing the voltage drop across said loop in a manner representative of its status; and means in said control unit for monitoring a signal indicative of the voltage drop across said loop to determine the status of an addressed alarm switch means; the improvement comprising means for controlling said control unit to check directly said signal indicative of the voltage drop across said loop in order to ascertain if an alarm condition exists, and means for integrating said signal indicative of the voltage drop across said loop before monitoring thereof by said control unit in order to determine the status of an addressed identification module.

2. An alarm system in accordance with claim 1 wherein said integrating means has a time constant on the order of 10 milliseconds.

3. An alarm system in accordance with claim 1 wherein said control unit includes programmable comparator means for representing a threshold level and for indicating if an input signal is above or below said threshold level, and means for selectively enabling said controlling means and said integrating means to furnish an input signal for said programmable comparator means.

4. In an alarm system having a control unit; a plurality of alarm switches; wire means for connecting said alarm switches to said control unit; a plurality of identification modules associated with respective ones of said alarm switches; means in said control unit for causing current to flow through said wire means and for checking a first signal in said wire means which is indicative of the condition of said alarm switches as a group to ascertain if an alarm condition exists; means in said control unit responsive to the existence of an alarm condition for generating a series of address codes on said wire means to address said identification modules individually; each of said identification modules including means responsive to its individual addressing for applying to said wire means a second signal which is representative of its status; and means in said control unit for monitoring the applied signal to determine the status of an addressed identification module; the improvement comprising means for controlling said control unit to check directly said first signal indicative of the condition of said alarm switches as a group in order to ascertain if an alarm condition exists, and means for integrating said second signal representative of the status of an addressed identification module before monitoring by said control unit in order to determine said status.

5. An alarm system in accordance with claim 4 wherein said integrating means has a time constant on the order of 10 milliseconds.

6. An alarm system in accordance with claim 4 wherein said control unit includes programmable comparator means for representing a threshold level and for indicating if an input signal is above or below said threshold level, and means for selectively enabling said controlling means and said integrating means to furnish an input signal for said programmable comparator means.

7. In an alarm system having a control unit; a wire loop whose two ends terminate at said control unit; a plurality of alarm switches disposed along said loop; a plurality of identification modules connected in parallel with respective ones of said alarm switches; means in said control unit for causing a direct current to flow through said loop and for checking a signal indicative of the voltage drop across said loop to ascertain if an alarm condition exists; means in said control unit responsive to the existence of an alarm condition for generating a series of address codes in the loop to address said identification modules individually; each of said identification modules including means responsive to its ihdividual addressing for changing the voltage drop across said loop in a manner representative of its status; and means in said control unit for monitoring a signal indicative of the voltage drop across said loop to determine the status of an addressed identification module; and wherein each of said identification modules presents an impedance to current flowing in said loop when the alarm switch across which it is connected is open, and said control unit ascertains the existence of an alarm condition when the voltage drop across said loop changes due to an increased loop impedance; an improvement for verifying the existence of an alarm condition comprising means responsive to the ascertainment of the existence of an alarm condition for changing the magnitude of the current flowing through said loop, and means for determining whether the resulting change in the signal indicative of the voltage drop across said loop is a linear function of the change in the magnitude of the loop current.

8. In an alarm system having a control unit; a wire loop whose two ends terminate at said control unit; at least one alarm switch means disposed along said loop; and means in said control unit for causing a direct current to flow through said loop and for checking a signal indicative of the voltage drop across said loop to ascertain if an alarm condition exists; and wherein said at least one alarm switch means changes its impedance to current flowing in said loop when it represents an alarm condition, and said control unit ascertains the existence of an alarm condition when the voltage drop across said loop changes due to a changed loop impedance; an improvement for verifying the existence of an alarm condition comprising means responsive to the ascertainment of the existence of an alarm condition for changing the magnitude of the current flowing through said loop, and means for determining whether the resulting change in the signal indicative of the voltage drop across said loop is a linear function of the change in the magnitude of the loop current.

9. In an alarm system having a control unit; a wire loop whose two ends terminate at said control unit; a plurality of alarm switches disposed along said loop; a plurality of identification modules connected in parallel with respective ones of said alarm switches; means in said control unit for causing a direct current to flow through said loop and for checking a signal indicative of the voltage drop across said loop to ascertain if an alarm condition exists; means in said control unit responsive to the existence of an alarm condition for generating a series of address codes in the loop to address said identification modules individually; each of said identification modules including means responsive to its individual addressing for changing the voltage drop across said loop in a manner representative of its status; and means in said control unit for monitoring a signal indicative of the voltage drop across said loop to determine the status of an addressed identification module; the improvement comprising means in said control unit for representing upper and lower limits for a window around a voltage drop across said loop, which window contains the voltage drop indicated by said monitored signal if an indentification module has a predetermined status when it responds to its addressing, said control unit being operative to determine said predetermined status only if the monitored signal is indicative of a voltage drop which is both lower than said upper limit and higher than said lower limit, said control unit further addressing each indentification module and performing at least three tests involving alternating limits of said window.

10. An alarm system in accordance with claim 9 wherein for each of said tests said control unit checks the level of the monitored signal and performs the test on a majority-vote basis.

11. An alarm system in accordance with claim 9 wherein said monitoring means includes programmable comparator means for representing a threshold level and for indicating if an input signal is above or below said threshold level, and said control unit determines said predetermined status by selectively adding an offset signal to the monitored signal and causing said programmable comparator means to operate on the resulting sum signal whereby said predetermined status can be determined without changing the threshold level represented by said programmable comparator means.

12. An alarm system in accordance with claim 11 wherein said programmable comparator means has two inputs and operates in a differential mode, and said control unit includes means operative during the addressing of an individual identification module for developing at one of said inputs a first signal indicative of the voltage drop across said loop when said identification module responds to its addressing, and for developing at the other of said inputs a second signal indicative of the voltage drop across said loop when said identification means is not responding to its addressing, said second signal being developed in the same cycle during which said identification module is addressed.

13. An alarm system in accordance with claim 12 wherein successive identification modules are addressed during successive cycles, and said control unit includes means for pulsing said loop at the start of each cycle in a manner which rapidly compensates for parasitic capacitances.

14. An alarm system in accordance with claim 9 wherein said programmable comparator means has two inputs and operates in a differential mode, and said control unit includes means operative during the addressing of an individual identification module for developing at one of said inputs a first signal indicative of the voltage drop across said loop when said identification module responds to its addressing, and for developing at the other of said inputs a second signal indicative of the voltage drop across said loop when said identification module is not responding to its addressing, said second signal being developed in the same cycle during which said identification module is addressed.

15. An alarm system in accordance with claim 9 wherein successive identification modules are addressed during successive cycles, and said control unit includes means for pulsing said loop at the start of each cycle in a manner which rapidly compensates for parasitic capacitances.

16. In an alarm system having a control unit; a plurality of alarm switch means; wire means for connecting all of said alarm switch means to said control unit; means in said control unit for generating a series of address codes on said wire means to address said alarm switch means individually; each of said alarm switch means including means responsive to its individual addressing for changing the level of a signal on said wire means in a manner representative of its status; and means in said control unit for monitoring said signal level to determine the status of an addressed alarm switch means; the improvement comprising means in said control unit for representing upper and lower limits for a window around a signal level which is caused to appear on said wire means by an alarm switch means which has a predetermined status when it responds to its addressing, said control unit being operative to determine said predetermined status only if the monitored signal level is both lower than said upper limit and higher than said lower limit, said monitoring means including programmable comparator means for representing a threshold level and for indicating if an input signal is above or below said threshold level, and said control unit determining said predetermined status by selectively adding an offset signal to the monitored signal level and causing said progammable comparator means to operate on the resulting sum signal whereby said predetermined status can be determined without changing the threshold level represented by said programmable comparator means.

17. An alarm system in accordance with claim 16 wherein for the addressing of each alarm switch means said control unit peforms at least three tests involving alternating limits of said window.

18. An alarm system in accordance with claim 17 wherein for each of said tests said control unit checks said signal level and performs the test on a majority-vote basis.

19. An alarm system in accordance with claim 16 wherein said programmable comparator means has two inputs and operates in a differential mode, and said control unit includes means operative during the addressing of an individual alarm switch means for developing at one of said inputs a first signal indicative of signal level when said alarm switch means responds to its addressing, and for developing at the other of said inputs a second signal indicative of the signal level when said alarm switch means is not responding to its addressing, said second signal being developed in the same cycle during which said alarm switch means is addressed.

20. An alarm system in accordance with claim 19 wherein successive alarm switch means are addressed during successive cycles, and said control unit includes means for pulsing said wire means at the start of each cycle in a manner which rapidly compensates for parasitic capacitances.

21. An alarm system in accordance with claim 16 wherein said programmable comparator means has two inputs and operates in a differential mode, and said control unit includes means operative during the addressing of an individual alarm switch means for developing at one of said inputs a first signal indicative of the signal level when said alarm switch means responds to its addressing, and for developing at the other of said inputs a second signal indicative of the signal level when said alarm switch means is not responding to its addressing, said second signal being developed in the same cycle during which said alarm switch means is addressed.

22. An alarm system in accordance with claim 16 wherein successive alarm switch means are addressed during successive cycles, and said control unit includes means for pulsing said wire means at the start of each cycle in a manner which rapidly compensates for parasitic capacitances.

23. An alarm system comprising a control unit; a plurality of alarm switch means; wire means for connecting all of said alarm switch means to said control unit; means in said control unit for generating a series of address codes on said wire means to address said alarm switch means individually; each of said alarm switch means including means responsive to its individual addressing for changing the level of an analog signal on said wire means in a manner representative of its status; means in said control unit for monitoring said analog signal level to determine the status of an addressed alarm switch means; and means in said control unit operative during the addressing of an individual alarm switch means for developing a first signal indicative of the analog signal level when said alarm switch means responds to its addressing, and for developing a second signal indicative of the analog signal level when said alarm switch means is not responding to its addressing, said first and second signals being developed for one alarm switch means before the addressing of another.

24. An alarm system in accordance with claim 23 wherein successive alarm switch means are addressed successive cycles, and said control unit includes means for pulsing said wire means at the start of each cycle in a manner which rapidly compensates for parasitic capacitances.

* * * * *